US008986233B2

(12) United States Patent
Aoki et al.

(10) Patent No.: US 8,986,233 B2
(45) Date of Patent: Mar. 24, 2015

(54) LEG ASSIST DEVICE

(75) Inventors: Eisuke Aoki, Aichi-gun (JP); Shuhei Manabe, Miyoshi (JP); Hitoshi Konosu, Nagoya (JP); Masayuki Imaida, Ichinomiya (JP); Issei Nakashima, Toyota (JP); Yasuhiro Ebihara, Okazaki (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 852 days.

(21) Appl. No.: 13/242,151

(22) Filed: Sep. 23, 2011

(65) Prior Publication Data

US 2012/0071797 A1 Mar. 22, 2012

Related U.S. Application Data

(63) Continuation of application No. PCT/JP2010/054551, filed on Mar. 17, 2010.

(51) Int. Cl.
*A61H 3/00* (2006.01)
*A61H 1/02* (2006.01)

(52) U.S. Cl.
CPC ..... *A61H 3/00* (2013.01); *A61H 1/024* (2013.01); *A61H 1/0244* (2013.01); *A61H 1/0266* (2013.01); *A61H 2201/0173* (2013.01); *A61H 2201/0176* (2013.01); *A61H 2201/1215* (2013.01); *A61H 2201/5007* (2013.01);
(Continued)

(58) Field of Classification Search
USPC ..... 601/23, 33–35; 602/16, 23, 26; 700/245, 256, 260, 292
See application file for complete search history.

(56) References Cited

U.S. PATENT DOCUMENTS 6,517,503 B1 * 2/2003 Naft et al. ..... 602/16
8,273,042 B2 * 9/2012 Lidolt et al. ..... 602/16
(Continued)

FOREIGN PATENT DOCUMENTS

JP 63-043036 A 2/1988
JP 4-52993 A 2/1992
(Continued)

OTHER PUBLICATIONS

International Search Report of PCT/JP2010/054551 mailed May 18, 2010 & Written Opinion.
(Continued)

*Primary Examiner* — Justine Yu
*Assistant Examiner* — Timothy Stanis
(74) *Attorney, Agent, or Firm* — Kenyon & Kenyon LLP

(57) ABSTRACT

A leg assist device having an abnormality management procedure which appropriately adapts to an abnormal situation is provided. The leg assist device is provided with a leg attachment and a controller. The leg attachment comprises upper and a lower links connected with a rotary joint, and an actuator. The upper link is to be attached to the upper leg of the user. The lower link is to be attached to the lower leg of the user. The actuator swings the lower link relative to the upper link. The controller outputs the commands so that the swing angle of the lower link follows a target trajectory. Further, the controller executes a first abnormality management process in which the controller shuts off torque transmission from the actuator to the user when the controller detects an abnormality before outputting the commands to the actuator.

3 Claims, 12 Drawing Sheets

(52) U.S. Cl.
CPC . *A61H2201/5069* (2013.01); *A61H 2201/5071* (2013.01); *A61H 2201/164* (2013.01); *A61H 2201/1642* (2013.01); *A61H 2201/165* (2013.01); *A61H 2201/1676* (2013.01); *A61H 2201/5061* (2013.01); *A61H 2201/5082* (2013.01)
USPC ..... 601/34; 700/260

(56) References Cited

U.S. PATENT DOCUMENTS

| | | | | |
|---|---|---|---|---|
| 2006/0211966 | A1* | 9/2006 | Hatton et al. | 602/16 |
| 2008/0255489 | A1 | 10/2008 | Genda et al. | |
| 2009/0036804 | A1* | 2/2009 | Horst | 601/5 |
| 2010/0125229 | A1* | 5/2010 | Rudolph et al. | 602/16 |

FOREIGN PATENT DOCUMENTS

| | | | |
|---|---|---|---|
| JP | 2002-191654 | A | 7/2002 |
| JP | 2004-147726 | A | 5/2004 |
| JP | 2004-329520 | A | 11/2004 |
| JP | 2005-088166 | A | 4/2005 |
| JP | 2006-061460 | A | 3/2006 |
| JP | 2007-007799 | A | 1/2007 |
| JP | 2007-054086 | A | 3/2007 |
| JP | 2009-207840 | A | 9/2009 |
| WO | 2007/108551 | A1 | 9/2007 |

OTHER PUBLICATIONS

International Preliminary Report on Patentability issued Nov. 17, 2010 of PCT/JP2010/054551.

* cited by examiner

LEG ASSIST DEVICE

CROSS-REFERENCE TO RELATED APPLICATION

This application is a Continuation of International Application No. PCT/JP2010/054551 filed on Mar. 17, 2010, the disclosure of which is hereby incorporated by reference herein in its entirety.

TECHNICAL FIELD

The present invention relates to a leg assist device which assists leg motion by applying torque to the joint of the user's leg. A motion assist device which empowers the user's muscles by applying torque on the joints of the user's limbs is being developed. Such a device typically has a multi-link multi-joint robot mechanism attached along the user's limbs. The motion assist device having such a mechanism may be often referred to as "a robot suits", "a exoskeleton robot", or "a powered orthosis". The technology disclosed in the present description relates to such so-called devices, especially to a leg assist device that is to be attached along the user's leg.

DESCRIPTION OF RELATED ART

There are two types of leg assist devices. One is a device for a person who has been trained to handle the device, such as a worker or military personnel. The other is a device for a person who has not been trained, such as a physically challenged person. The technology discloses herein is more likely to relate to the latter device than the former device. Some of the technical terms used in the present description will be explained here. In the present description, a leg which the user can entirely control is referred to as "a sound leg" and a leg with at least one joint which the user can not properly control is referred to as "an affected leg". Further, a part of the leg between the knee and the ankle is referred to as "a lower leg" and a part of the leg between the hip joint and the knee is referred to as "an upper leg"

The leg assist device for assisting the leg motion comprises a leg attachment which is to be attached to the user's leg as a typical mechanism. The leg attachment comprises: an upper link to be attached to an upper leg of a user; a lower link to be attached to a lower leg of the user; a rotary joint rotatably connecting the upper link and the lower link; and an actuator that swings the lower link relative to the upper link The leg assist device substantially applies torque to the user's knee joint and thus, supports walking motion, sitting down motion, or standing up motion. It is noted that a leg assist device may also have an actuator that applies torque to the user's ankle or hip joint other than the actuator that applies torque to the knee joint. However, since human's motion tends to put heavy load on the knee joint, the main purpose of such a leg assist device is to apply torque to the knee joint in order to reduce the load on the knee joint.

When an abnormality occurs in the leg assist device that assists the leg motion, it may lead to the user falling down. Therefore, the leg assist device may preferably have measures for preventing the user from falling down when an abnormality occurs. Especially, it is important to provide such measures for the leg assist device to be used by a physically challenged person who is less able to control his/her leg properly.

As one example of such means, Japanese Patent Application Publication No. 2006-61460 (referred to as "patent document 1" hereinafter) discloses a leg assist device which shuts off power transmission to the user when an abnormality is detected. Furthermore, Japanese Patent Application Publication No. 2002-191654 (referred to as "patent document 2" hereinafter) discloses a leg assist device which is able to keep holding the knee joint even if the power supply is lost by employing a ball screw as a torque transmission mechanism to the knee joint.

BRIEF SUMMARY OF INVENTION

The technique disclosed by the patent document 1 releases the knee joint so that the knee joint can be passively rotated freely when the abnormality occurs. The technique disclosed by the patent document 2 locks the knee joint when the abnormality occurs. Here, the phrase "the knee joint can be passively rotated freely" means that the lower leg is allowed to rotate in response to the external force. In the case where the knee joint is passively rotated freely, the knee joint can be prevented from being overloaded, however, it may not hold up the user's own weight. In the case where the knee joint is locked, the knee joint can hold up the user's own weight, however, it may suffer overloads. In the case where an abnormality occurs, how such is to be dealt with depends on the situation thereof. The present invention provides a leg assist device having an abnormality management procedure which appropriately adapts to the type of the abnormal situation.

The leg assist device disclosed by the present description comprises a leg attachment and a controller. The leg attachment comprises: an upper link to be attached to an upper leg of a user; a lower link to be attached to a lower leg of the user; a rotary joint rotatably connecting the upper link and the lower link; and an actuator that swings the lower link relative to the upper link. The controller outputs commands to the actuator so that the swing angle of the lower link follows a target trajectory.

Upon such a leg assist device, there are some situations that should be considered for determining procedures in dealing with the abnormality. One typical situation is a situation before outputting the commands to the actuator. A typical actuator is a motor. In the case where the motor is provided, the motor does not rotate unless commands are supplied to the motor even if power is supplied to a control circuit of the motor. Thus, the controller preferably shuts off the torque transmission from the actuator to the user when an abnormality is detected in a period after having supplied the power to the motor (the actuator) but before outputting the commands to the actuator. By shutting off the torque transmission from the actuator to the user, because torque is not applied to the user at least from the actuator, an excessive force is prevented from being transmitted from the actuator to the user. It is noted that the phrase "shut off the torque transmission" may mean both of cutting the power (such as electric power) from the power source to the actuator; and cutting a power transmission path from the actuator to the lower link. As for the latter case, a clutch may be provided between an output shaft of the actuator and the lower link, and the torque transmission can be shut off e.g. by releasing the clutch.

The rotary joint may preferably prohibit backward swing of the lower link when the controller shuts off the torque transmission. More preferably, the rotary joint may have be provided with an one-way clutch that prohibits the backward swing of the lower link and allows forward swing of the lower link. It is noted that the phrase "backward swing of the lower link" means a swing of the lower link to a direction toward which the user's knee bends. On the other hand, the phrase "forward swing of the lower link" means a swing of the lower link to a direction toward which the user's knee straightens.

To simplify the following explanation, the phrase "backward swing of the lower link" is referred to as "backward swing" or "swing backward", and the phrase "forward swing of the lower link" is referred to as "forward swing" or "swing forward" hereinafter.

The leg attachment can keep holding up user's own weight even after shutting off the torque transmission by prohibiting the backward swing of the lower link. On the other hand, the knee joint can be prevented from being applied with the excessive force in directions other than a weight holding direction by allowing the forward swing of the lower link.

In addition, the novel abnormality management procedures disclosed by the present description will be explained throughout the embodiments.

DETAILED DESCRIPTION OF INVENTION

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved leg assist device.

Figure 1:
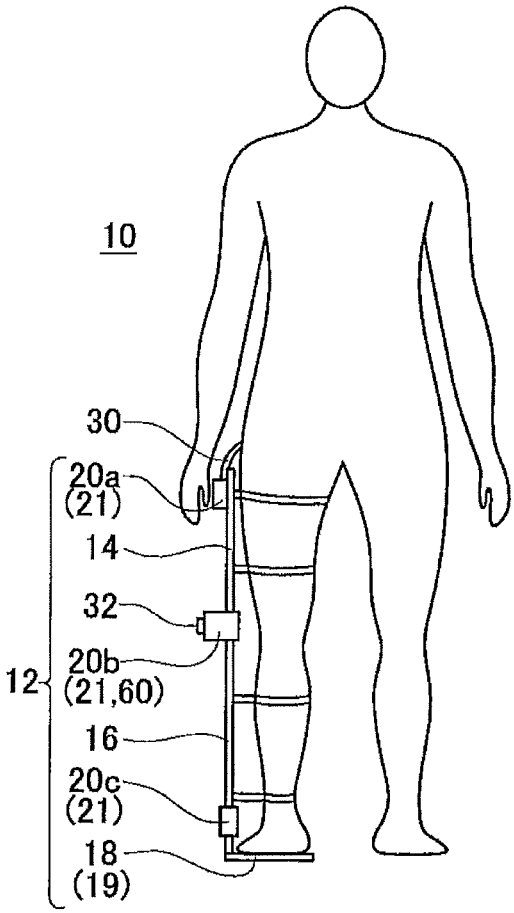
FIG. 1 shows a front view of a leg assist device.
Figure 2:
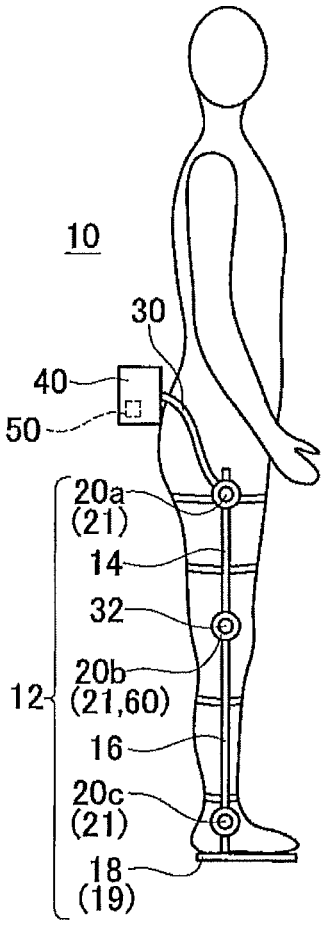
FIG. 2 shows a side view of the leg assist device.

A preferred embodiment of the present invention will be explained with reference to the drawings. FIG. 1 shows a front view of a leg assist device 10. FIG. 2 shows a side view of the leg assist device 10. The leg assist device 10 is provided with a leg attachment 12 that is to be attached along the user's right leg and a controller 40. The dashed line drawn in the controller 40 represents a battery 50. The battery supplies electricity (power) to a motor 32 and to the controller. The leg assist device 10 of the present embodiment is a device for a user who is not able to properly control the knee joint of the right leg, and the device supports his/her walking motion, sitting down motion, or standing up motion. That is, the leg assist device 10 is a device for a user having one affected leg.

A mechanical configuration of the leg attachment 12 will be explained. The leg attachment 12 is to be attached on an outside of the right leg of the user along the upper leg to the lower leg. The leg attachment 12 is configured with a multi-joint multi-link mechanism having an upper link 14, a lower link 16, and a foot link 18. The upper end of the upper link 14 is rotatably connected to a waist link 30 via a first joint 20*a*. The upper end of the lower link 16 is rotatably connected to a lower end of the upper link 14 by a second joint 20*b*. The foot link 18 is rotatably connected to a lower end of the lower link 16 by a third joint 20*c*. The upper link 14 is to be fixed to the upper leg of the user by a belt. The lower link 16 is to be fixed to the lower leg of the user by a belt. The foot link 18 is to be fixed to the user's sole by a belt. The belt for fixing the foot link 18 is not depicted in the figures. The waist link 30 is to be fixed to the body trunk (waist) of the user. The joints 20*a*, 20*b*, and 20*c* are rotary joints that swing adjacent links each other.

When the user wears the leg attachment 12, the first joint 20*a*, the second joint 20*b*, and the third joint 20*c* are coaxially aligned with the pitch axis of the right hip joint, the pitch axis of the knee, and the pitch axis of the ankle of the user, respectively. Each link of the leg attachment 12 can swing in response to the motion of the user's right leg. Each joint includes an encoder 21. The encoder 21 detects a swing angle between two adjacent links connected to the joint. In other words, the encoder 21 detects an angle of the corresponding joint. The encoder 21 of the first joint 20*a* detects the joint angle of the user's right hip joint around pitch axis. The encoder 21 of the second joint 20*b* detects the joint angle of the user's right knee joint around pitch axis. The encoder 21 of the third joint 20*c* detects the joint angle of the user's right ankle joint around pitch axis. The encoders 21 attached on each joint are collectively referred to as "the angle sensors 21" hereinafter. Further, an angle between two links corresponds to a swing angle. The swing angle of the link corresponds to the joint angle of the user's corresponding joint. For example, the swing angle of the second joint 20*b* which coaxially aligns with the knee joint corresponds to the angle of the user's knee joint.

The ground sensors 19 are attached to the foot link 18. The ground sensors 19 are provided at the two positions: front and rear of the sole of the foot link 18. The ground sensors 19 detect whether the right leg is in contact with the ground or not. Typically, the ground sensor 19 may be an ON/OFF switch that outputs "ON" signal when the sole of the foot link 18 is grounding and outputs "OFF" signal when the sole is floating. Alternatively, the ground sensors 19 may be pressure sensors that measure pressure. In the case of the: pressure sensors, it is determined as "grounding" when the detected pressure is above a predetermined threshold, and it is determined as "not grounding" when the detected pressure is below the predetermined threshold.

A motor 32 (actuator) is attached to the second joint 20*b*. The motor 32 is disposed outside the use's knee joint. The motor 32 coaxially aligned with the user's knee joint. The motor 32 is able to swing the lower link 16 relative to the upper link 14. That is, the motor 32 can apply torque to the user's right knee joint. Furthermore, a one-way clutch 60 is provided to the joint 20*b*. The one-way clutch 60 prohibits the backward swing of the lower link 16 and allows the forward swing of the lower link 16 when it engages with the joint 20*b*. The explanation of the mechanical structure of the one-way clutch 60 is omitted because the one-way clutch is widely used, e.g. for the automatic transmission of a car and so on. It is noted that the one-way clutch configured by a ratchet mechanism is also well known.

This leg assist device 10 supports the walking motion, sitting down motion, or standing up motion, by applying torque to the user's right knee joint by the motor 32. The controller 40 of the leg assist device 10 stores a target trajectory of the swing angle of the lower link 16. The "target trajectory" is time series data of the target swing angle for the lower link 16. The "target trajectory" represents the chronological change of the swing angle of the lower link for an ideal leg motion. The leg assist device 10 leads the user's lower leg so as to realize the ideal leg motion during walking by swinging the lower link 16 along the target trajectory.

As mentioned before, the target swing angle corresponds to the angle of the lower link 16 relative to the upper link 14, and also corresponds to the user's knee joint angle. The target trajectory may be stored in the controller 40 in advance, or may be generated by the controller 40 in real time. For example, in the case of assisting walking motion, the controller 40 alternately generates a stance leg target trajectory and a swing leg target trajectory. The stance leg target trajectory is a target trajectory on which the right leg is in the stance phase and the swing leg target trajectory is a target trajectory on which the right leg is in the swing phase. When the right leg is in the swing phase, the controller 40 generates, based on the current condition, the stance leg target trajectory for the subsequent stance phase. On the other hand, the controller 40 generates, based on the current condition, the swing leg target trajectory for the subsequent swing phase when the right leg is in the stance phase. The stance leg does not move because the toe of the stance leg is fixed on the ground. In contrast, the toe of the swing leg moves well. Since the restraint conditions are different as mentioned above, the leg assist device 10 divides one step cycle into the stance leg target trajectory and the swing leg target trajectory.

Figure 3:
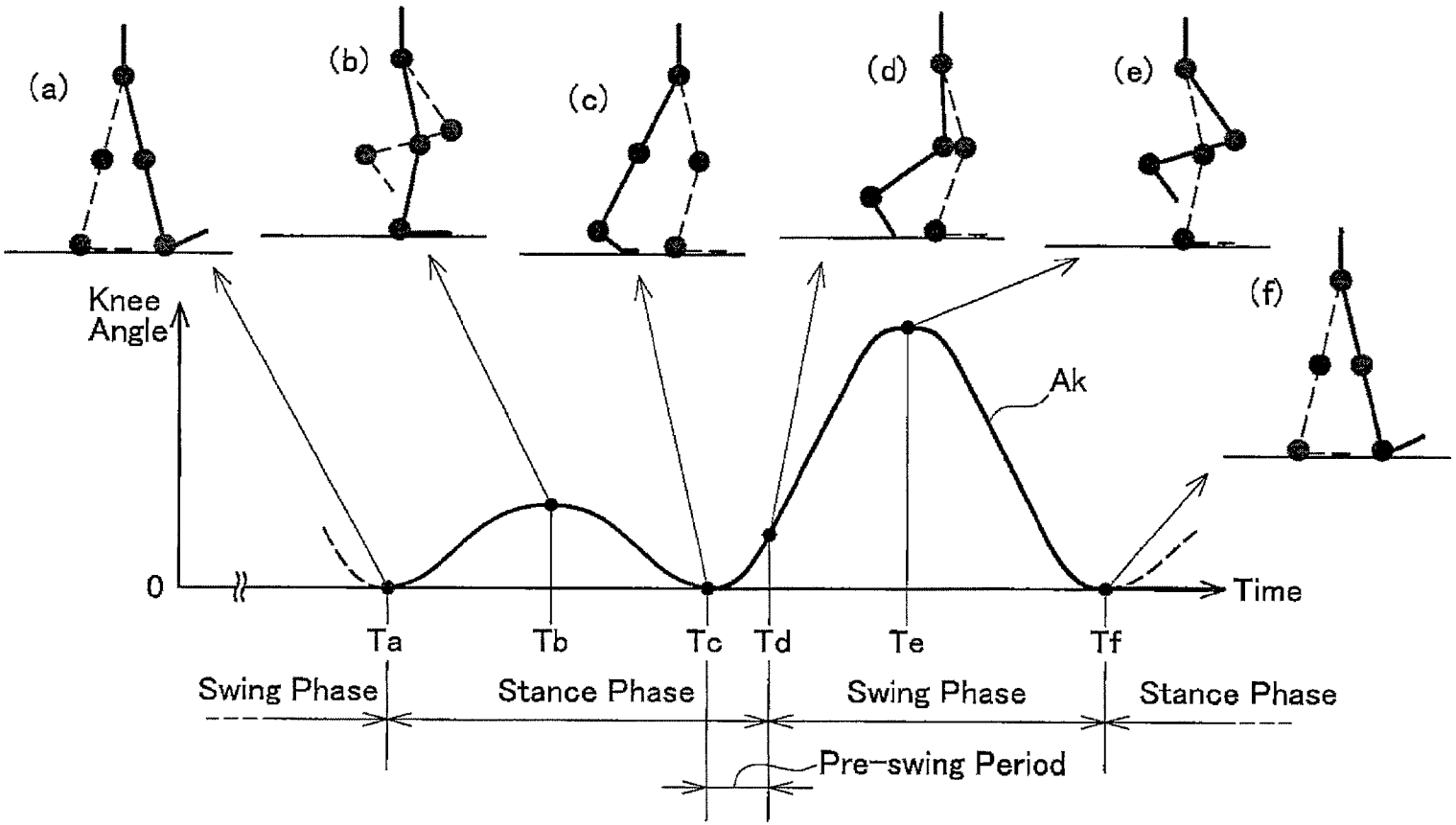
FIG. 3 shows an example of a target trajectory of a knee joint swing angle.

The stance leg target trajectory and the swing leg target trajectory, i.e. a chronological change of the knee joint angle during normal walking motion will be explained in detail. FIG. 3 shows motion of the right leg during walk. A graph denoted by the symbol Ak represents a chronological change of the right knee joint angle (knee angle). The knee angle Ak also corresponds to the time series data of the target swing angle of the lower link 16, e.g. the target trajectory. It is noted that the graph in FIG. 3 represents an outline (a trend) of the time variation of the knee angle Ak (the target trajectory), and does not represent precise time variation of the knee angle.

Figure 4:
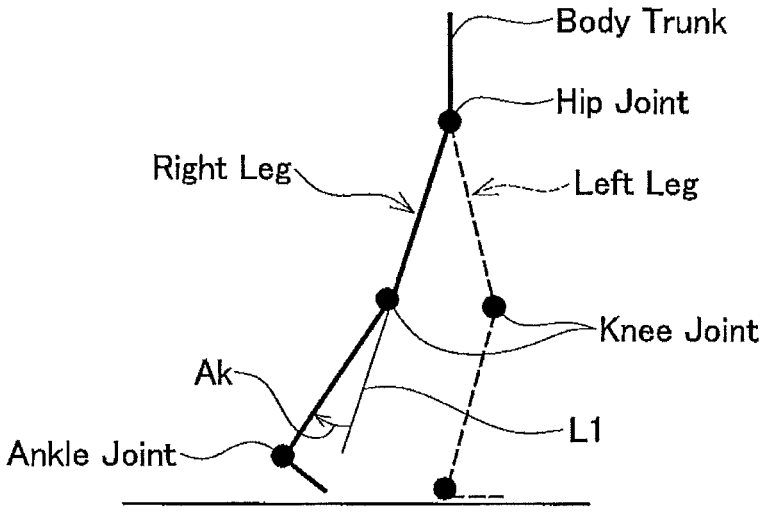
FIG. 4 shows an explanation of parameters used in FIG. 3.

FIG. 4 gives an explanation for the definition of the knee angle Ak. The solid line represents the right leg and the dashed line represents the left leg. The solid line above the hip joint represents the body trunk. The notations of the solid and dashed lines in FIG. 4 are the same as in FIG. 3. The straight line L1 represents a line connecting the hip joint and the knee joint. The straight line L1 extends along the longitudinal direction of the upper leg. The knee angle Ak is defined as an angle measured from the straight line L1 to the lower leg. The knee being straightened corresponds to the knee angle Ak=0. The knee being flexed at a right angle corresponds to the knee angle Ak=+90.

Back to FIG. 3, the explanation for the target trajectory will be continued. At the timing Ta, the right leg grounds. At the timing Td, the right leg takes off. The period from the timing Ta to the timing Td corresponds to the stance phase. At the timing Tb, the knee angle Ak reaches the maximum angle during the stance phase of the right leg. The timing Tc corresponds to a timing at which the lower leg starts swinging backward while the heel of the right leg starts floating, in the last part of the stance phase. At the timing Tf, the right leg grounds again. At the timing Te, the knee angle Ak reaches the maximum angle during the swing phase. The leg configurations for each timing are depicted from (a) to (f) in FIG. 3. As shown in (a) and (f), the knee of the right leg is straightened at the timings Ta and Tf, and thus the knee angle Ak=0. The configuration of the leg at the timing Tc is depicted in (c) in FIG. 3. As the solid line (the right leg) in (c) indicates, at the timing Tc, the lower leg starts swinging backward while the toe remains grounding. That is, the trend of the time variation of the knee angle Ak reverses from decrease to increase at the timing Tc. Furthermore, the right leg positions most backward at the timing Tc, and the right leg swings forward after the timing Tc.

The right leg grounds at the timing Td. The configuration of the leg at the timing Td is depicted in (d) in FIG. 3. During the period from the timing Tc to the timing Td, the whole right leg swings forward while the foot of the right leg is grounding. This period is called as "a pre-swing period". The knee angle Ak reaches the maximum angle at the timing Te during the swing phase. At the timing Te, the knee angle on the leg in the stance phase also reaches the maximum angle. Tb denotes the timing at which the knee angle Ak reaches the maximum angle during the stance phase and the leg configurations in (e) and in (b) are the same except that the right leg and the left leg are switched.

The period from the timing Ta to the timing Td corresponds to the stance phase and the period from the timing Td to the timing Tf corresponds to the swing phase. During the stance phase, the leg is grounding and the toe does not move. During the swing phase, the toe of the leg is floating and moves. The controller 40 generates the target trajectory (the stance leg target trajectory), during the swing phase, for the subsequent stance phase, and generates the target trajectory (the swing leg target trajectory), during the stance phase, for the subsequent swing phase. The controller 40 stores a default pattern of the target trajectory in advance, and determines the target trajectory for the subsequent phase by modifying the default pattern based on the current condition such as the walking speed. The stance phase and the swing phase are different in terms of whether the toe is fixed or is floating (moving). Therefore, the controller 40 divides the target trajectory for one step cycle into the stance leg target trajectory and the swing leg target trajectory, since the algorithms for modifying the default pattern are different.

The controller 40 controls the motor 32, in accordance with each target trajectory, so that the lower link 16 follows the chronological change represented on the target trajectory. Specifically, the target trajectory corresponds to the time series data of the commands to the motor 32, and the controller 40 sequentially outputs the commands to the motor 32.

Figure 5:
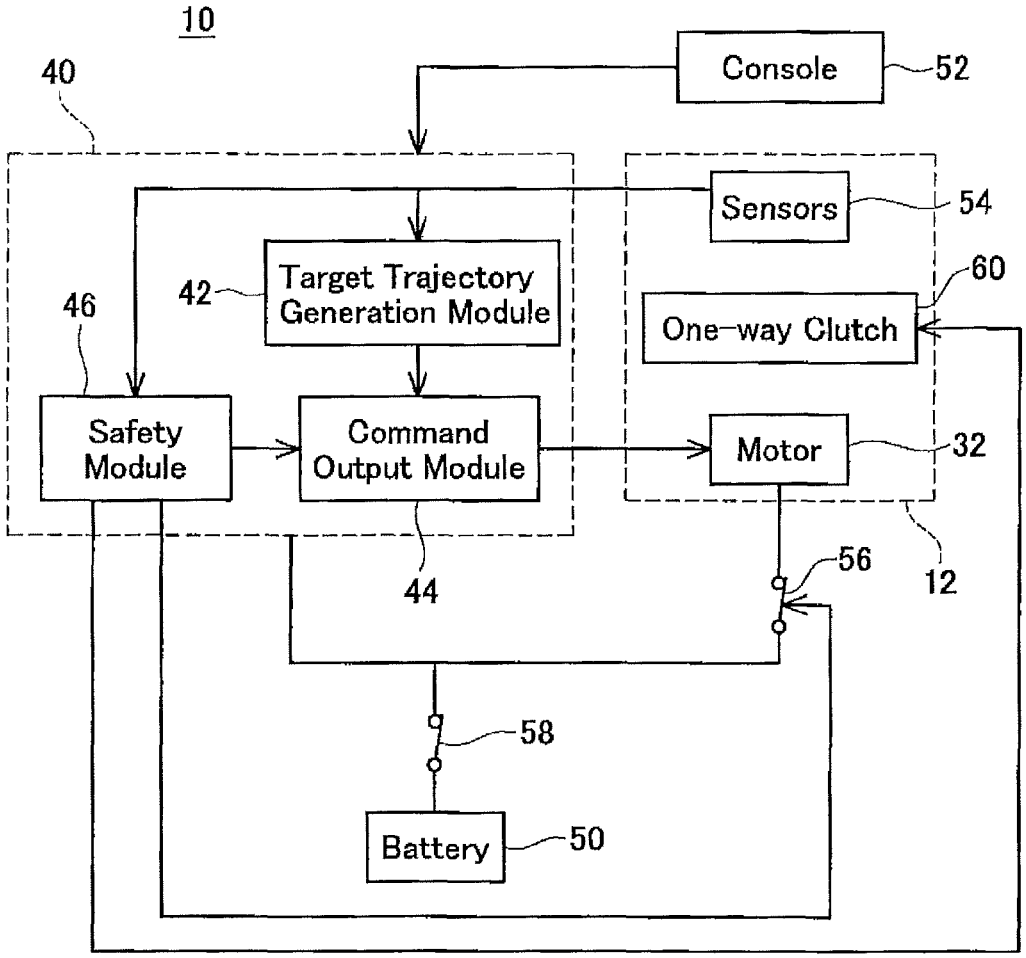
FIG. 5 shows a control block diagram of the leg assist device.

Next, the functional configuration of the leg assist device 10 will be explained FIG. 5 shows a block diagram of the leg assist device 10. A target trajectory generation module 42, a command output module 44, and safety module 46 are provided in the controller 40. Those modules are realized by software (program). Actually, the CPU that executes the software functions as the respective modules.

The reference number 52 in FIG. 5 denotes a console that is to be operated by the user. The reference number 54 in FIG. 5 denotes all sensors provided in the leg assist device 10. Therefore, the sensors 54 include the encoder 21 that detects the swing angle of each link, the ground sensor 19 that detects whether the foot grounds. Moreover, the sensors 54 may include, e.g., a temperature sensor for detecting whether or not the motor 32 is overheated, a sensor that detects a disconnection of a power cable that supplies the electric power to the other units from the battery, and an overcurrent sensor that detects whether an excessive current flows into the motor 32. The safety module 46 detects an abnormality based on the sensor data from the sensors 54.

The reference number 58 denotes a main switch of the leg assist device 10. When the main switch is turned on, the electric power (drive power) is supplied to the controller 40 and the motor 32. The reference number 56 denotes a power shutoff switch inserted between the battery 50 and the motor 32. The power shutoff switch 56 is a so-called normally-off type switch that is open (shutting off the power line between the battery 50 and the motor 32) while the electrical power is not supplied and is closed (connecting the power line from the battery 50 to the motor 32) while the electrical power is supplied. The safety module 46 supplies the electrical power to the power shutoff switch 56. It means that when the electrical power from the safety module 46 is lost, the power shutoff switch opens, and thus, the electrical power to the motor 32 is shut off.

The controller 40 executes a variety of functions such as assisting the walking motion, assisting the standing up motion, or assisting the sitting down motion, based on the user's instructions inputted through the console 52. For example, in the case when the user instructs of assisting walking motion, the controller 40 generates the target trajectory for assisting the walking motion. As mentioned above, the target trajectory for assisting the walking motion is divided into the stance leg target trajectory and the swing leg target trajectory. Alternatively, in the case when the user instructs of assisting the sitting down motion, the controller 40 generates the target trajectory for assisting the sitting down motion. Alternatively, in the case when the user instructs of assisting standing up motion, the controller 40 generates the target trajectory for assisting the standing up motion. The target trajectory generation module 42 generates the target trajectory. The target trajectory generation module 42 stores the default patterns of the target trajectories for each motion. The target trajectory generation module 42 modifies the default pattern based on the sensor data from the sensors 54. The modified default pattern corresponds to the final target trajectory for driving the motor 32.

The generated target trajectory is sent to the command output module 44. The command output module 44 outputs the commands to the motor 32 on each sampling cycle. The motor 32 does not rotate unless the commands are supplied even if the power is supplied from the battery 50. Specifically, at first, the electricity from the battery 50 is supplied to a control circuit associated with the motor 32. However, the control circuit does not supply electrical power to a rotor of the motor 32 until the control circuit receives commands from the upper unit (the controller 40 in this embodiment). The control circuit starts supplying electrical power to the rotor when the control circuit receives the commands from the upper unit. That is, the motor 32 rotates only after receiving the commands from the controller 40.

The safety module 46 determines an occurrence of abnormality from sensor data of the sensors 54. The safety module 46 may shut off the power supply to the motor 32, or may switch the one-way clutch 60 between engaging and releasing, or may control the command output module 44, depending on the type of the abnormality. In the case of shutting off the power supply to the motor 32, the safety module 46 cuts the electricity supply to the power shutoff switch 56. The shutoff of the power supply to the motor 32 corresponds to the one embodiment of the shutoff of the torque transmission from the motor 32 (actuator) to the user.

Figure 6:
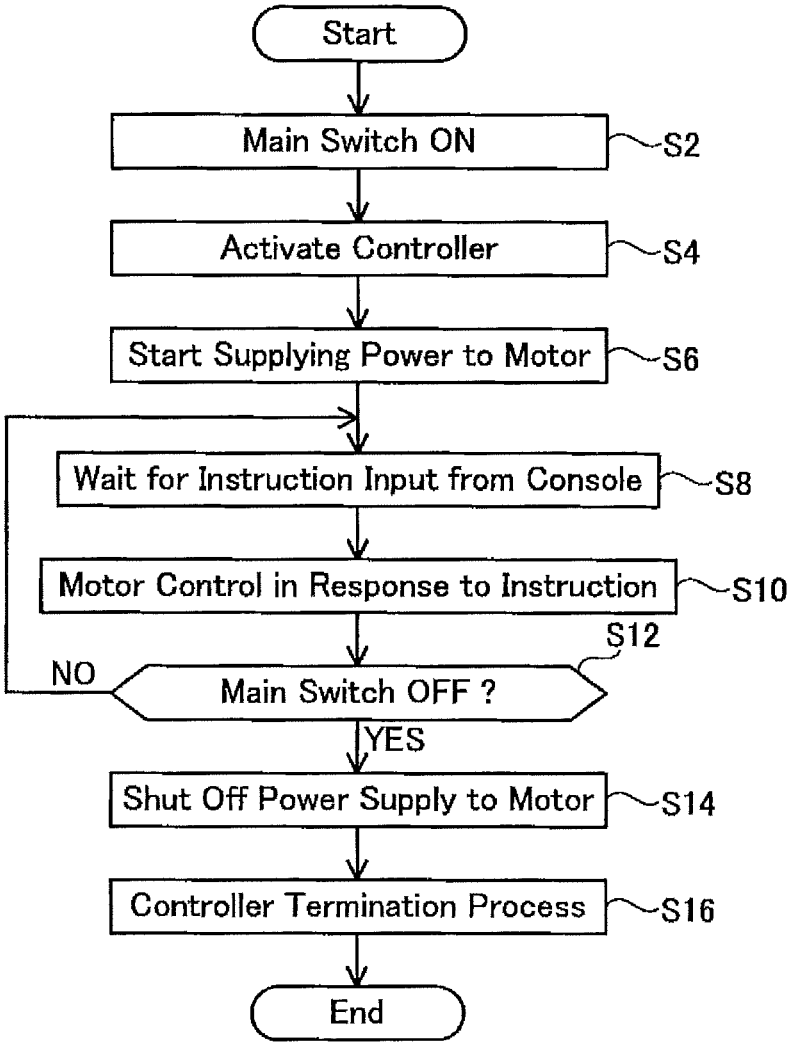
FIG. 6 is a flowchart for an overall flow of control of the leg assist device.

Before explaining the process that the safety module 46 executes, an overall flow of a control of the leg assist device 10 will be explained. FIG. 6 shows a flowchart for an overall flow of control of the leg assist device. When the user turns on the main switch (S2), the controller 40 is activated (S4). At step S4, the target trajectory generation module 42, the command output module 44, and the safety module 46 are initialized. In the process of initializing the safety module 46, electricity is supplied to the power shutoff switch 56 and thus, the power shutoff switch 56 closes (becomes electrically conductive). Then, power supply to the motor 32 (actuator) starts (S6). After step S6, the leg assist device 10 waits for the instruction input from the user (S8). When the instruction is inputted from the user, the leg assist device 10 executes the motor control corresponding to the instruction. For example, if the instruction from the user is the assist of walking motion, the controller 40 controls the motor 32 so that the lower link 16 follows the target trajectory while alternately generating the target trajectories for the walking motion, i.e. the stance leg target trajectory and the swing leg target trajectory. When the process moves to step S10, outputting of the commands to the motor 32 starts.

When the motor control corresponding to the user's instruction terminates, the leg assist device 10 returns to the waiting for the instruction input from the user again. Meanwhile, if the main switch is turned off (S12: YES), the controller 40 shuts off the power supply to the motor 32 (S14) and then performs the termination process (S16). The situation before executing step S10 corresponds to the situation of "before outputting the commands to the motor 32".

Figure 7:
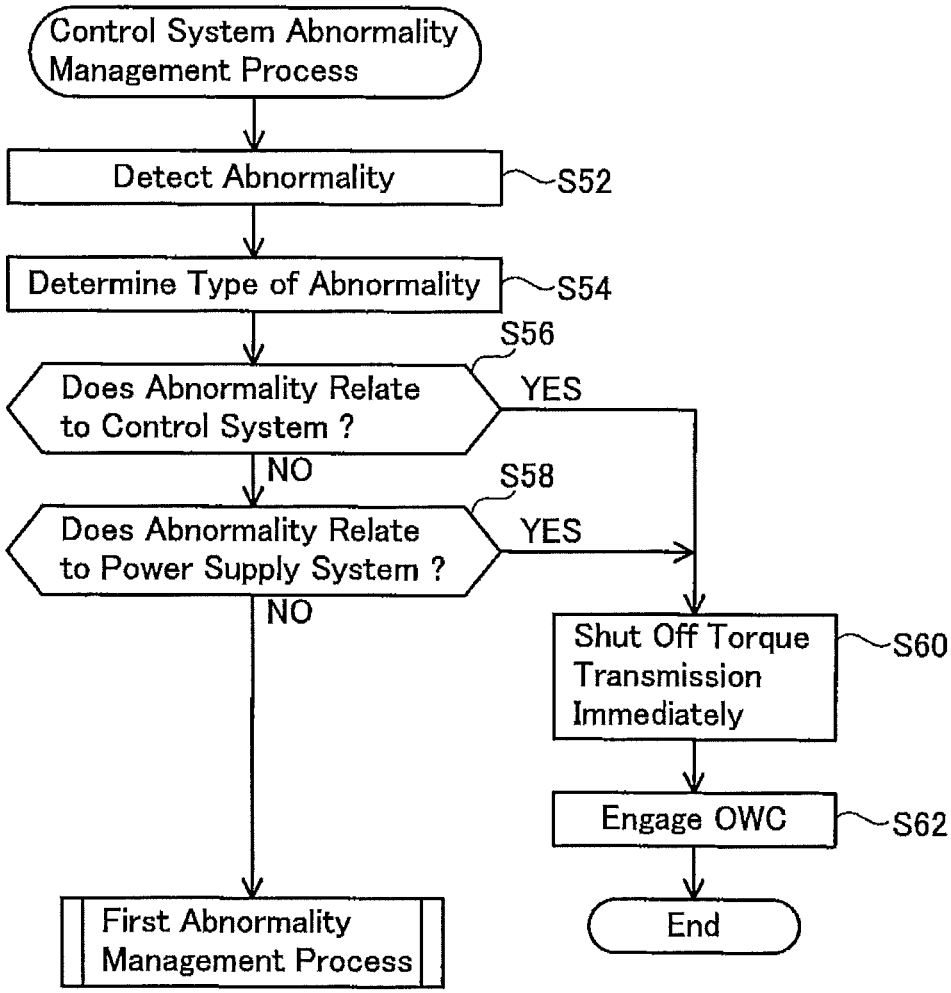
FIG. 7 shows a flowchart for a control system abnormality management process.
Figure 8:
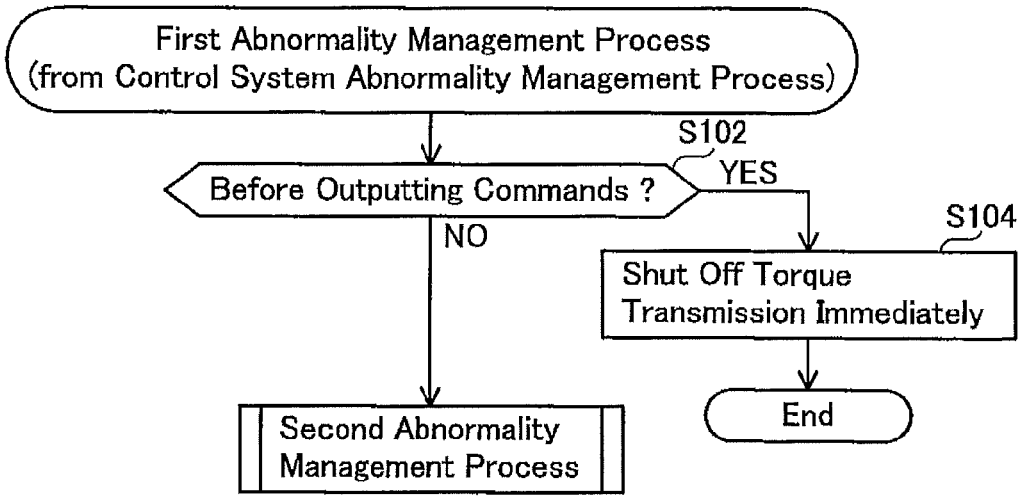
FIG. 8 shows a flowchart for a first abnormality management process.
Figure 9:
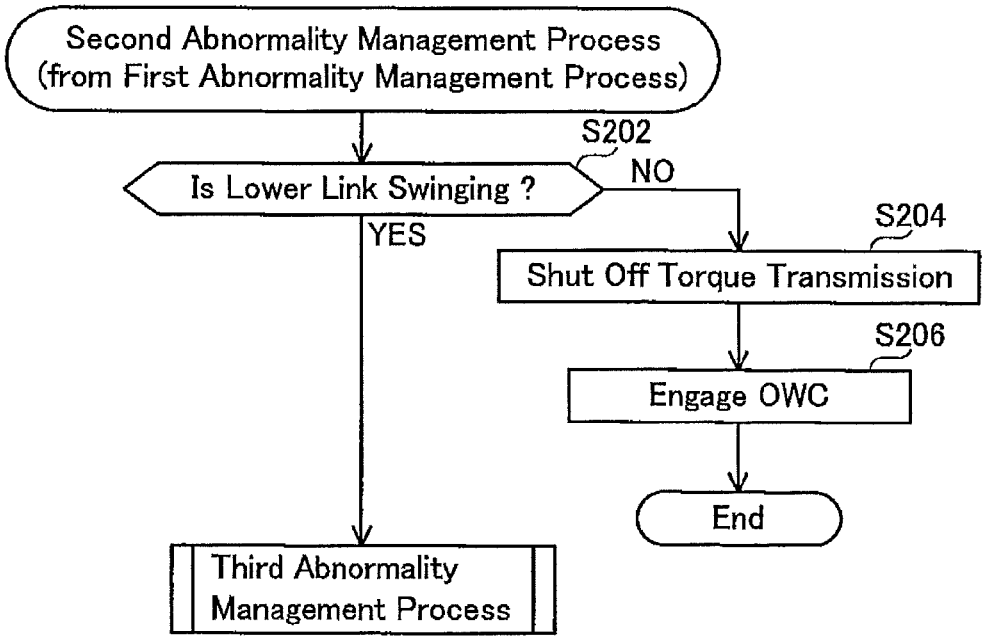
FIG. 9 shows a flowchart for a second abnormality management process.
Figure 10:
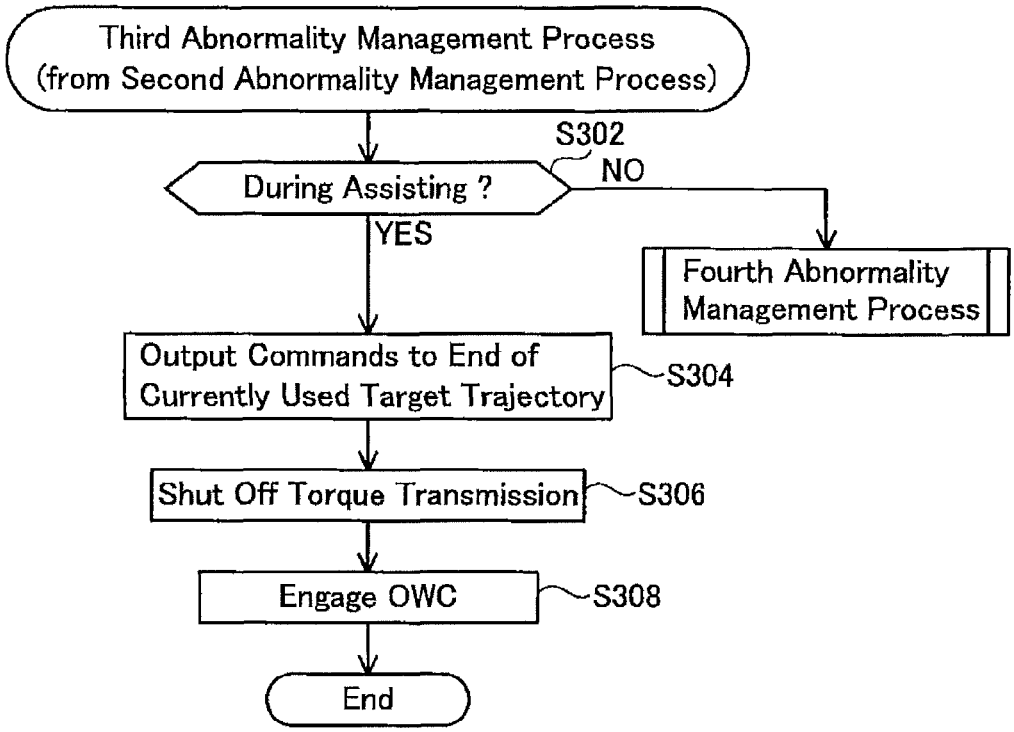
FIG. 10 shows a flowchart for a third abnormality management process.
Figure 11:
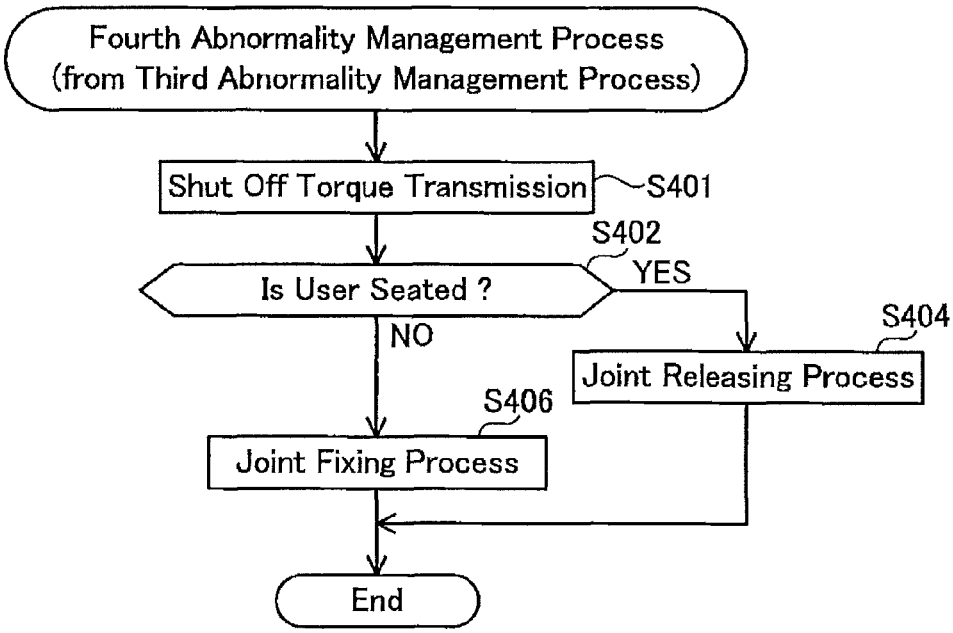
FIG. 11 shows a flowchart for a fourth abnormality management process.

Next, the process that the safety module 46 executes will be explained. The safety module 46 executes the control system abnormality management process (FIG. 7), the first abnormality management process (FIG. 8), the second abnormality management process (FIG. 9), the third abnormality management process (FIG. 10), and the fourth abnormality management process (FIG. 11). The safety module 46 executes those abnormality management processes in the above described order. The safety module 46 repeatedly executes the above processes for every predetermined cycle.

The control system abnormality management process (FIG. 7) will be explained. When the safety module 46 detects an abnormality (S52), the safety module 46 initially determines whether or not the type of the detected abnormality relates to the control system (S54). Examples of the abnormality related to the control system are described as follows. The safety module 46 determines that the abnormality related to the control system has occurred in a case where the safety module 46 receives sensor data that indicates overheat of the motor. Also, the safety module 46 determines that the abnormality related to the control system has occurred in a case where the difference between the detected swing angle and the target swing angle of the lower link exceeds a predetermined range. Examples of the abnormality not related to the control system are described as follows. The safety module 46 determines that an abnormality not related to the control system has occurred in a case where the communication between the console 52 and the controller 40 is lost. Also, the safety module 46 determines that the abnormality not related to the control system has occurred in a case where the remaining battery charge falls below a predetermined level. Furthermore, the safety module 46 determines that the abnormality not related to the control system has occurred in a case where the communication with one of the ground sensors 19 is lost.

The safety module 46 immediately stops supplying the power to the power shutoff switch 56 when it determines that the abnormality which relates to the control system has occurred (S56:YES). That is, the safety module 46 immediately shuts off the torque transmission (S60). Next, the safety module 46 engages the one-way-clutch (S62). The symbol "OWC" in the drawings means the one-way clutch. That is, prior to the first abnormality management process (FIG. 8) which is discussed later, the safety module 46 (the controller 40) determines whether or not the detected abnormality relates to the actuator control system (S56), and shuts off the torque transmission immediately when it determines that the detected abnormality relates to the actuator control system (S60). When the abnormality that relates to the control system has occurred, the controller 40 immediately shuts off the torque transmission. According to the above process, the leg assist device 10 surely stops the actuator. It prevents the user from being applied an excessive force from the actuator because the torque is not applied to the user at least from the actuator when the torque transmission is shut off.

The safety module 46 executes the first abnormality management process (FIG. 8) if the occurred abnormality does not relate to the control system. On the first abnormality management process, the safety module 46 determines whether or not the controller 40 is under the situation of "before outputting the commands to the motor 32" (S102). If the controller 40 is under the situation of "before outputting the commands" (S102:YES), the safety module 46 immediately stops supplying power to the power shutoff switch 56. It means that the safety module 46 immediately shuts off the torque transmission (S104). The controller 40 shuts off the torque transmission when it detects the abnormality before outputting the commands to the actuator (S104).

Next, the safety module 46 executes the second abnormality management process (FIG. 9) if the detected abnormality has occurred after outputting the commands (S102: NO). On the second abnormality management process, the safety module 46 determines whether or not the lower link 16 is currently swinging (S202). The safety module 46 shuts off the torque transmission (S204) and engages the one-way clutch (S206), if it determines that the lower link 16 is not swinging (S202: NO).

Next, the safety module 46 executes the third abnormality management process (FIG. 10) if it determines that the lower link 16 is currently swinging (S202: YES). In the third abnormality management process, at first, the safety module 46 determines whether or not the leg assist device 10 is in operation of assisting any of user's motion (such as the walking motion, standing up motion, or sitting down motion). Here, the phrase "assist user's motion" means that the controller 40 controls the motor 32 so that the lower link 16 follows the target trajectory. The operation mode is determined. For example, if the leg assist device 10 is operating on the walking assist mode, the determination of the step S302 results "YES". When the leg assist device 10 is in operation of assisting user's motion (S302: YES), the safety module 46 continues to output the commands to an end of the target trajectory (the stance leg target trajectory or the swing leg target trajectory) that was being used when the abnormality had been detected (S304). The safety module 46 shuts off the torque transmission after outputting the command to the end of the target trajectory (S306). At the same time, the safety module 46 engages the one-way clutch (S308).

In the case where the abnormality has occurred during the operation and the abnormality does not relate to the control system, it is highly likely to be able to continue the assistance in operation for a while. In such a situation, the leg assist device 10 outputs the commands to the end of the current stance leg (or swing leg) target trajectory, and shuts off the torque transmission thereafter. Either of the stance leg control or the swing leg control terminates with both legs having grounded (refer to the graph in FIG. 3). Therefore, by continuing outputting the commands to the end of the target trajectory for either of the stance leg or swing leg control, the controller 40 shuts off the torque transmission after both legs have grounded. It means that the controller 40 shuts off the torque transmission under the condition in which the user is standing stably. Furthermore, the controller 40 engages the one-way clutch at this occasion. Therefore, the leg attachment 12 can hold the user's weight because backward swing of the lower link 16 is prohibited.

Next, the safety module 46 executes the fourth abnormality management process (FIG. 11) if the leg assist device 10 is not in operation of assisting user's motion (S302: NO). In the fourth abnormality management process, at first, the safety module 46 shuts off the torque transmission (S401). Next, the safety module 46 determines whether or not the user is seated based on the swing angle of the lower link 16 (S402). Particularly, the safety module 46 determines that the user is seated when the swing angle of the lower link is in the predetermined range. The predetermined range is a range over 45 degrees for example. The condition in which the swing angle of the lower link 16 is over 45 degrees means that the lower link 16 swings backward more than 45 degrees from the knee straightened position. In the case where the lower link 16 swings backward more than 45 degrees, it may probably mean that the user is seated or the user's hip positions just above the seat. That is, in the case where the lower link 16 swings backward more than 45 degrees, it may highly probably mean that the user is seated. Preferably, the safety module 46 may also use the information of the ground reaction force loaded to the sole and/or the information of the inclined angle (angle with respect to the vertical) of the user's upper leg for determining whether or not the user is seated. By using those information it can determine whether or not the user is seated with higher probability.

The safety module 46 executes the joint releasing process (S404) if it determines that the user is seated (S402: YES). On the other hand, the safety module 46 executes the joint fixing process (S406) if it determines that the user is not seated (S402: NO). Here, "the joint releasing process" means to put the lower link into the condition in which the lower link can be passively swung freely in either forward or backward direction. Further, the condition in which the lower link can be passively swung freely means to allow the lower link to be swung by the external force. For example, "the condition in which the lower link can be passively swung freely" may be achieved by cutting the electrical current to the motor 32 if the starting torque from the lower link 16 to the motor 32 is small. It may also be achieved by disengaging the clutch if the clutch is provided between the motor 32 and the lower link 16. "The joint fixing process" means to at least prohibit the lower link 16 from swinging backward. For example, engaging the aforementioned one-way clutch is one example of "the joint fixing process". If the motor 32 is provided with a brake, operating the brake is also one example of "the joint fixing process". It is noted that both of the forward and backward swings of the lower link 16 are prohibited when the brake is operated.

The steps of S402, S404, and S406 provide the following advantages. When the user is seated, the user may be safe even if the joint is released. On the other hand, when the user is not seated, i.e. the user may probably be standing up, the user may fall down if the joint is released. In such a case, the leg attachment 12 holds the user's weight and prevents the user from falling down by fixing the joint instead of releasing the joint.

Figure 12:
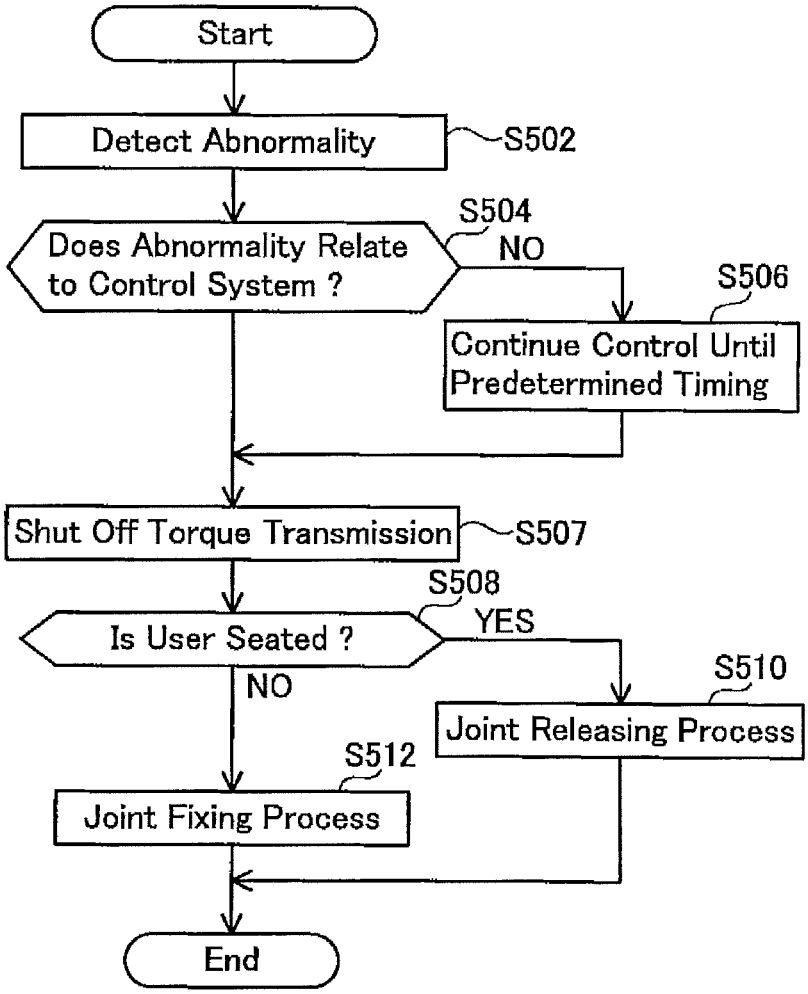
FIG. 12 shows a flowchart for another embodiment of the abnormality management process.

Next, the other embodiment of the abnormality management process executed by the safety module 46 will be explained FIG. 12 shows the other embodiment of the abnormality management process. The flowchart of FIG. 12 may be implemented in the safety module 46 instead of the abnormality management process shown by FIG. 7 to FIG. 11.

When the safety module 46 detects the abnormality (S502), the safety module 46 determines whether or not the detected abnormality relates to the actuator control system. If the safety module 46 determines that the detected abnormality relates to the actuator control system (S504: YES), the safety module 46 immediately shuts off the torque transmission (S507). On the other hand, if the safety module 46 determines that the detected abnormality does not relate to the actuator control system (S504: NO), the safety module 46 shuts off the torque transmission after continuing the actuator control until the predetermined timing that is defined on the target trajectory (S506, S507). Typically, the predetermined timing may preferably be a timing at which the right leg (affected leg) grounds. That is, after the abnormality is detected, the safety module 46 continues the actuator control based on the target trajectory until the right leg (affected leg) grounds, and after that, the safety module 46 shuts off the torque transmission. The safety module 46 determines whether the right leg (affected leg) grounds based of the sensor data of the ground sensors 19.

The safety module 46 shuts off the torque transmission and determines whether or not the user is seated (S508). The safety module 46 executes the joint releasing process (S510) if it determines that the user is seated. The safety module 46 executes the joint fixing process (S512) if it determines that the user is not seated.

Figure 13:
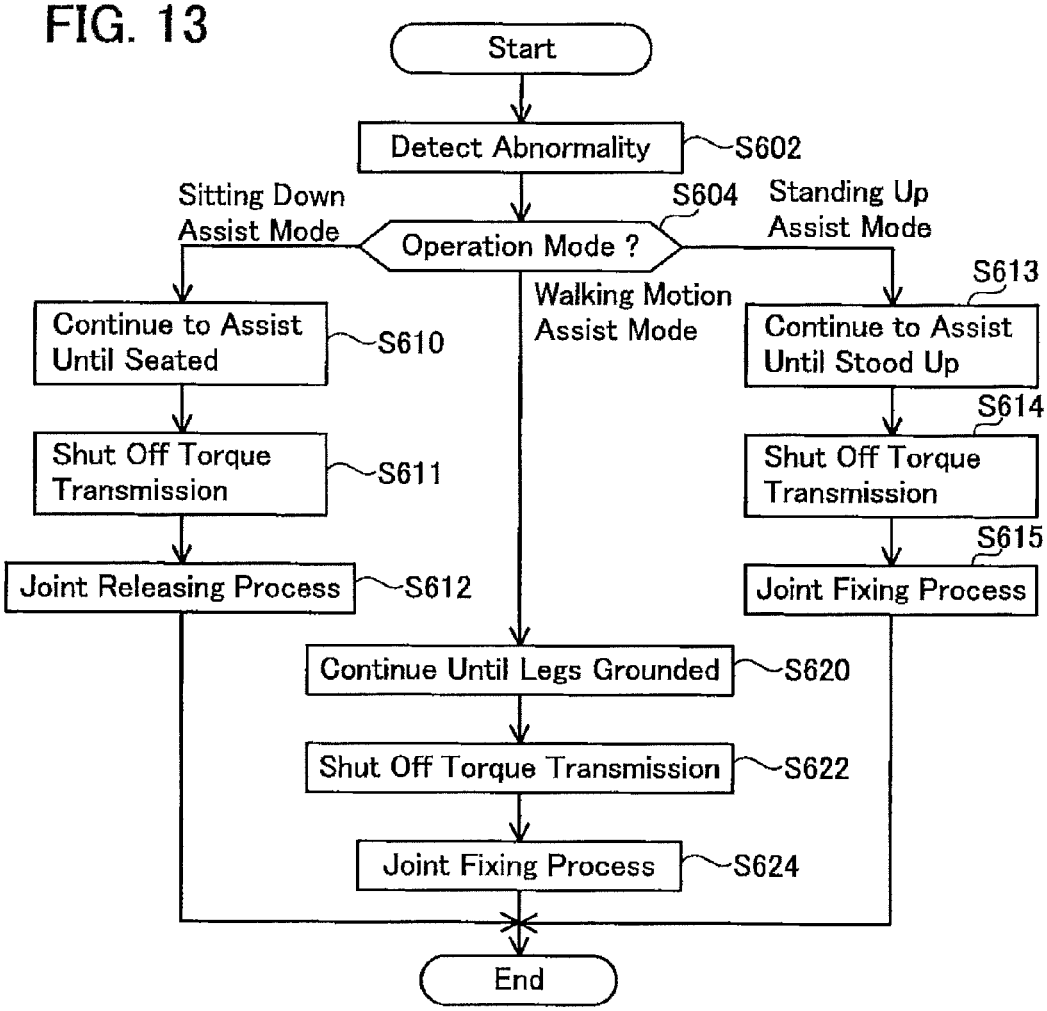
FIG. 13 shows a flowchart for yet another embodiment of the abnormality management process.

Another embodiment of the abnormality management process by the safety module 46 will be explained. FIG. 13 shows a flowchart of yet another embodiment of the abnormality management process. The flowchart of FIG. 13 may be implemented into the safety module 46 instead of the abnormality management process shown by FIG. 12. When the safety module 46 detects the abnormality (S602), the safety module 46 identifies the operation mode that the controller 40 is currently performing (S604). The operation mode may be distinguished by the type of the target trajectory currently employed for the actuator control. The walking assist mode for assisting the user's walking motion is the case where either the swing leg target trajectory or the stance leg target trajectory is employed. The sitting down motion assist mode is the mode that assists the user's sitting down motion. The standing up assist mode is the mode that assists the user's standing up motion.

In the case of the sitting down assist mode, the safety module 46 continues to assist until the user is seated (S610). After that, the safety module 46 shuts off the torque transmission and executes the joint releasing process (S611, S612). In the case of the standing up assist mode, the safety module 46 continues to assist until the user stands up (S613). After that, the safety module 46 shuts off the torque transmission and executes the joint fixing process (S614, S615). On the other hand, in the case of the walking motion assist mode, the safety module 46 continues the actuator control based on the target trajectory until both legs are grounded (S620). If the affected leg is in the swing phase, the safety module 46 monitors the sensor data of the ground sensor 19 and determines whether or not the affected leg has grounded. After the safety module 46 detects the grounding of the affected leg, the safety module 46 shuts off the torque transmission and executes the joint fixing process (S622, S624). The safety module 46 may determine whether or not the affected leg grounds based on the sensor data of the ground sensors 19.

Figure 14:
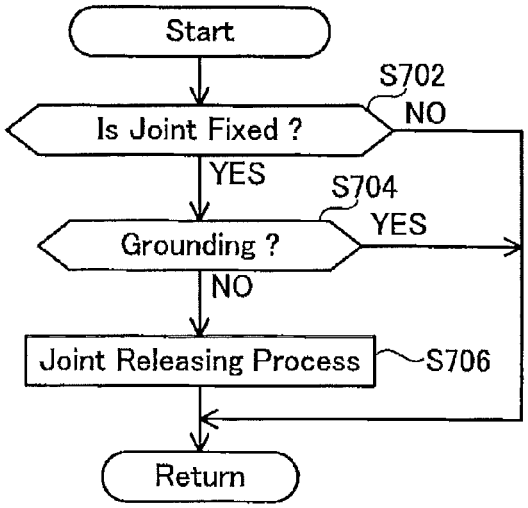
FIG. 14 shows a flowchart for a take-offjudging process.

In addition to any one of the above mentioned abnormality management processes, the safety module 46 of the leg assist device 10 preferably executes a take-off judging process shown in FIG. 14. The safety module 46 determines whether or not the joint is fixed (S702). If the joint is fixed (S702: YES), the safety module 46 determines whether or not the affected leg is grounding based on the sensor data of the ground sensor 19 (S704). If the affected leg does not ground (S704:NO), the safety module 46 releases the joint (S706).

The take-off judging process releases the second joint 20*b* if the affected leg takes off after the second joint 20*b* of the leg attachment 12 is once fixed. To fix the second joint 20*b* means to prohibit the backward swing of the lower leg 16. Therefore, when the second joint 20*b* is fixed, the leg attachment 12 can hold the user's weight. The affected leg taking off thereafter suggests that the user may probably be starting to fall down. In such a case, the leg assist device releases the second joint 20*b*, i.e., puts the second joint 20*b* into the condition in which the second joint 20*b* can be passively rotated freely so that the user's knee can rotate in response to the external force. According to such a process, it prevents the knee from being applied an unexpected excessive load.

Figure 15:
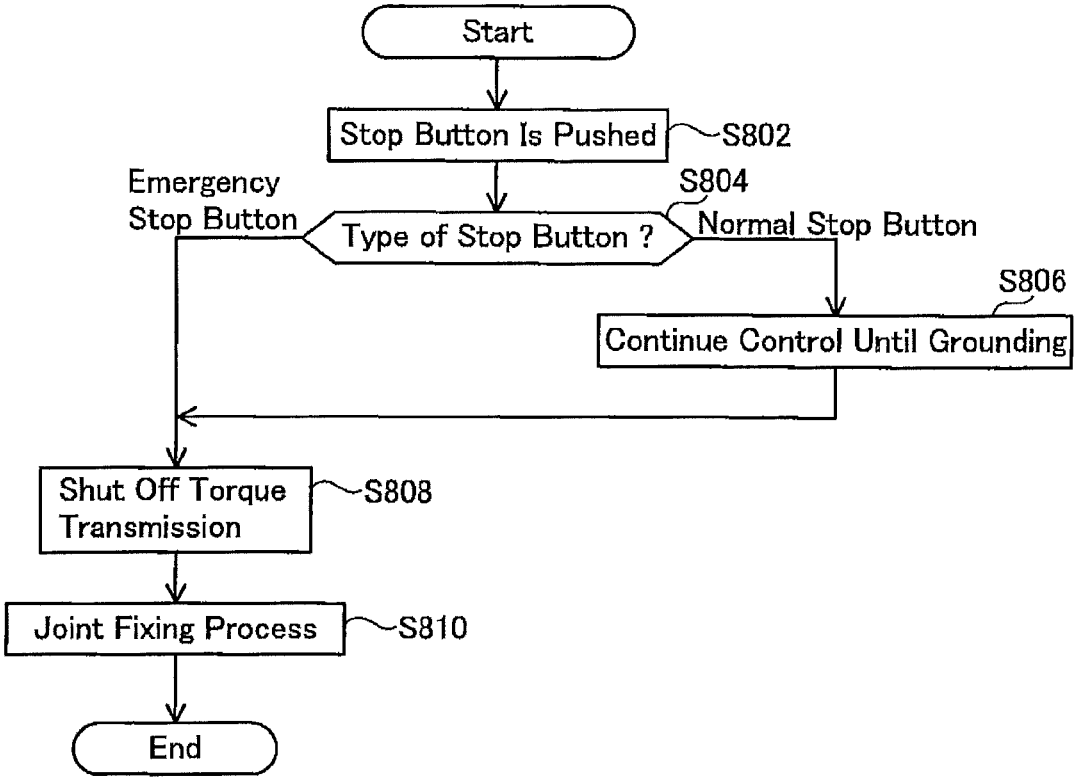
FIG. 15 shows a flowchart for a process when a stop button is pushed.

The leg assist device 10 also has a plurality of stop buttons. The stop buttons are provided on the console 52. One of the stop buttons is a "normal stop button" and the other one of the stop buttons is an "emergency stop button". The "emergency stop button" is a button that the user pushes when the user feels something wrong. That is, it is one of the determinations of type of the abnormality to distinguish the operation of the "emergency stop button" and the operation of the "normal stop button". FIG. 15 shows a flowchart for a process for button operations. When the safety module 46 detects that any of the buttons is operated (S802), the safety module 46 determines the type of the pushed button (S804). When the emergency stop button is pushed, the safety module 46 immediately shuts off the torque transmission (S808) and executes the joint fixing process (S810). On the other hand, when the normal stop button is operated, the safety module 46 continues the control based on the target trajectory until the feet grounds. After that, the safety module 46 shuts off the torque transmission (S808) and executes the joint fixing process (S810).

Some of the features of the above described embodiments of the leg assist device 10 and its modifications will be listed below. The second joint 20*b* is a rotary joint and is provided with the one-way clutch. The one-way clutch prohibits the backward swing of the lower link and allows the forward swing of the lower link In the first abnormality management process, when the controller 40 determines that the abnormality is detected after outputting the commands to the actuator, the controller 40 determines whether the lower link is in the swing motion. If the controller determines that the lower link is not in the swing motion, the controller 40 engages the one-way clutch. Those processes correspond to the above mentioned second abnormality management process.

The controller 40 alternately generates the stance leg target trajectory for the stance leg control and the swing leg target trajectory for the swing leg control when the leg assist device 10 assists the walking motion of the user. At the same time, the controller 40 outputs commands based on the stance leg target trajectory while the leg with the leg attachment 12 is being the stance leg and outputs commands based on the swing leg target trajectory while the leg with the leg attachment 12 is being the swing leg. The controller 40 outputs commands to the end of the target trajectory that has been used when the abnormality was detected, in the case, under the second abnormality management process, where the controller 40 determines that the lower link is in the swing motion. Then the controller 40 shuts off the torque transmission and engages the one-way clutch, after outputting the commands corresponding to the end of the target trajectory. Those processes correspond to the above mentioned third abnormality management process.

The leg assist device 10 is provided with the sensors 54 that detect the abnormality. The controller 40 controls the actuator so that the swing angle of the lower link follows the target trajectory. Furthermore, the controller executes, depending on the type of the detected abnormality, either the joint fixing process that prohibits the backward swing of the lower link or the joint releasing process that allows the lower link to be passively swung freely.

The controller 40 determines, based on the swing angle of the lower link, whether or not the user is being seated. The controller 40 executes the joint releasing process if it determines that the user is being seated, and executes the joint fixing process if it determines that the user is not being seated.

The controller 40 determines whether or not the detected abnormality relates to the actuator control system. When it is determined that the detected abnormality relates to the control system, the controller 40 immediately determines whether or not the user is being seated, and shuts the torque transmission. After that, the controller 40 executes, depending on the result of the determination, either the joint fixing process or the joint releasing process.

If the controller 40 determines that the detected abnormality does not relates to the control system, the controller 40 continues the actuator control until the timing that is predetermined on the target trajectory and then, determines whether or not the user is being seated. Next, the controller 40 shuts the torque transmission and then executes either the joint releasing process or the joint fixing process depending on the result of the determination.

If the controller 40 detects the abnormality during controlling the actuator based on the target trajectory for the standing up assistance, the controller 40 continues the actuator control until the end of the target trajectory for the standing up assistance, and after that, the controller 40 shuts off the torque transmission and executes the joint releasing process.

If the controller 40 detects the abnormality during controlling the actuator based on the target trajectory for assisting sitting down motion, the controller 40 continues the actuator control until the end of the target trajectory fort assisting sitting down motion, and after that, the controller 40 shuts off the torque transmission and executes the joint fixing process.

If the controller 40 detects the abnormality during controlling the actuator based on the target trajectory for walking motion assistance, the controller 40 continues the actuator control based on the target trajectory for walking motion assistance until grounding the right foot (the foot of the affected leg, e.g. the leg accompanying the leg attachment 12). When the controller 40 detects the grounding of the right foot, the controller 40 shuts off the torque transmission and executes the joint fixing process. If the one-way clutch is provided, the controller 40 executes the joint fixing process at the timing of detecting the abnormality and thus the leg assist device supports the knee joint to hold the user's weight When the affected leg is in the swing phase, the controller 40 continues the assistance until the swing leg grounds, and then, the controller 40 shuts off the torque transmission.

The leg assist device 10 is provided with the console (including the normal stop switch and the emergency stop switch which the user operates). When the emergency stop switch is operated, the controller 40 immediately shuts off the torque transmission. When the normal stop switch is operated, the controller 40 continues the actuator control until the predetermined timing that is predetermined on the target trajectory. The controller 40 shuts off the torque transmission when it reaches the predetermined timing.

Some remarks with regards to the embodiments and further modifications will be explained. After shutting off the torque transmission, the controller 40 preferably executes either the joint fixing process that prohibits backward swing of the lower link or the joint releasing process that allows the lower link to be passively rotated freely, based on at least the swing angle of the lower link and the determination of whether the user's right leg grounds. The determination of whether the user's leg grounds may be determined by the swing angle of the lower link. Furthermore, it may be expected that the user's leg does not ground when the right leg does not ground.

The operation of the safety module 46 of the embodiment may generally be expressed as follows. The safety module 46 executes either one of following four processes depending of the type of the detected abnormality (and status of the leg assist device 10):

(1) Immediate joint fixing process that immediately fixes the swing angle between the links;

(2) Immediate joint releasing process that immediately allows the link to be passively swung freely;

(3) After-motion joint fixing process that fixes the swing angle between the links after continuing the target trajectory following control until the timing that is predetermined on the target trajectory; and (4) After-motion joint releasing process that allows the link to be passively swung freely after continuing the target trajectory following control until the timing that is predetermined on the target trajectory.

On the leg assist device 10 of the embodiment, means for shutting the torque transmission is the power shutoff switch 56 that shuts off the power supply to the motor 32. Alternatively, the means for shutting the torque transmission may be provided by a clutch connected between the lower link 16 and the output shaft of the motor 32. The torque transmission will be shut off when the clutch is disengaged.

Combinations of features and steps disclosed in the present detail description may not be necessary to practice the invention in the broadest sense, and are instead taught merely to particularly describe representative examples of the invention. Furthermore, various features of the presently described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

What is claimed is:

1. A leg assist device comprising:

a leg attachment including:

an upper link to be attached to an upper leg of a user;

a lower link to be attached to a lower leg of the user;

a rotary joint rotatably connecting the upper link and the lower link; and an actuator that swings the lower link relative to the upper link; and a controller that outputs commands to the actuator so that a swing angle of the lower link follows a target trajectory;

wherein:

the rotary joint of the leg attachment includes a one-way clutch that prohibits backward swing of the lower link and allows forward swing of the lower link;

the controller executes:

a first abnormality management process in which the controller shuts off torque transmission from the actuator to the user when the controller detects an abnormality before outputting the commands to the actuator, and a second abnormality management process in which the controller shuts off the torque transmission and engages the one-way clutch after outputting the commands to an end of the target trajectory, when the controller detects the abnormality after having started outputting the commands to the actuator and the lower link is in swinging motion.

2. The leg assist device of claim 1 wherein, in a case where the leg assist device assists walking motion of the user:

the controller alternately generates a stance leg target trajectory for a stance leg control and a swing leg target trajectory for a swing leg control;

the controller outputs the commands based on the stance leg target trajectory while a leg with the leg attachment is in stance phase and outputs the commands based on the swing leg target trajectory while the leg with the leg attachment is in swing phase.

3. The leg assist device of claim 1 wherein the controller executes, prior to executing the first abnormality management process, a control system abnormality management process in which:

the controller determines whether or not the detected abnormality relates to an actuator control system; and the controller immediately shuts off the torque transmission when the controller determines that the detected abnormality relates to the actuator control system.

* * * * *